US006040528A

United States Patent [19]

Kitamura et al.

[11] Patent Number: 6,040,528

[45] Date of Patent: Mar. 21, 2000

[54] INSULATING SUPPORTING STRUCTURE FOR HIGH-VOLTAGE APPARATUS INCLUDING INORGANIC INSULATING LAYER FORMED ON A SURFACE OF AN ORGANIC INSULATING STRUCTURE

[75] Inventors: Tadao Kitamura; Hisaji Shinohara, both of Kawasaki, Japan

[73] Assignee: Fuji Electric Co., Ltd., Kawasaki, Japan

[21] Appl. No.: 08/324,396

[22] Filed: Oct. 17, 1994

[30] Foreign Application Priority Data

Oct. 18, 1993 [JP] Japan ..... 5-259503

[51] Int. Cl.[7] ..... H01B 17/00

[52] U.S. Cl. ..... 174/138 C; 174/209; 174/137 B; 174/52.1

[58] Field of Search ..... 174/209, 137 A, 174/137 B; 218/155, 118, 119; 200/293; 361/600–650

[56] References Cited

U.S. PATENT DOCUMENTS

| | | | |
|---|---|---|---|
| 2,389,386 | 11/1945 | Russell, Jr. | 428/454 |
| 2,431,474 | 11/1947 | Gaudenzi et al. | 174/152 GM |
| 3,076,053 | 1/1963 | Moussou | 174/209 |
| 3,118,968 | 1/1964 | Moussou | 174/209 |
| 3,812,284 | 5/1974 | Pohl | 174/188 |
| 4,476,155 | 10/1984 | Niemi | 427/58 |
| 4,845,318 | 7/1989 | Clabburn et al. | 174/209 |
| 4,956,903 | 9/1990 | Thuries | 174/209 |
| 4,965,407 | 10/1990 | Hamm | 174/31 R |
| 5,212,013 | 5/1993 | Gupta et al. | 428/381 |
| 5,246,729 | 9/1993 | Gupta et al. | 427/62 |
| 5,286,664 | 2/1994 | Horiuchi | 438/286 |
| 5,340,500 | 8/1994 | Chao et al. | 252/560 |

FOREIGN PATENT DOCUMENTS

| | | |
|---|---|---|
| 21 43 365 | 3/1973 | Germany . |
| 29 01 528 | 7/1980 | Germany . |
| 40 30 806 | 4/1992 | Germany . |
| 1 100 829 | 4/1989 | Japan . |
| 1 246 726 | 10/1989 | Japan . |
| 1408632 | 10/1975 | United Kingdom . |

OTHER PUBLICATIONS

Ta'a Electric Wire & Cable Co., Ltd.. TK1/ZYECAT, No. 48, 1994, pp. 96–99. No Month.

*Primary Examiner*—Kristine Kincaid
*Assistant Examiner*—Kamand Cuneo
*Attorney, Agent, or Firm*—Venable; Robert J. Frank; Michael A. Sartori

[57] ABSTRACT

An electrically insulating supporting structure for a high voltage electric apparatus having a high voltage charging part and a ground potential part, the structure being adapted to be disposed between the high voltage charging part apparatus and the ground potential part. The structure includes an organic insulating structure formed in a predetermined shape, and an inorganic insulating layer formed on a surface of the organic insulating structure and an intermediate layer consisting essentially of an organic and an inorganic powder.

8 Claims, 3 Drawing Sheets

INSULATING SUPPORTING STRUCTURE FOR HIGH-VOLTAGE APPARATUS INCLUDING INORGANIC INSULATING LAYER FORMED ON A SURFACE OF AN ORGANIC INSULATING STRUCTURE

BACKGROUND OF THE INVENTION

1. Field of the Invention

The present invention relates to an electric insulating supporting structure used in a high voltage electric apparatus such as a circuit breaker and a disconnecting switch.

2. Description of the Prior Art

In conventional high-voltage electric apparatuses, the insulating supporting structure is arranged between the high voltage charging part and the ground potential part. This insulating supporting structure is mechanically fixed. A porcelain insulating supporting structure is employed mainly as an outdoor high voltage apparatus, whereas an insulating supporting structure made of an organic insulating material is employed mainly as an indoor high voltage apparatus the organic insulating material having the advantage that it possesses mechanical strength and that it may be mass produced. Moreover, when a plastic such as an epoxy resin or a polyester resin is the organic insulating material being used, the shape of the electric insulating supporting structure can be freely designed, and, moreover provide a supporting structure which is lighter than a supporting structure made of porcelain, thus resulting in great advantages. As a consequence, an insulating supporting structure made of organic insulating materials may be used as not only a bushing and a supporting insulator, but also as an electric insulating case for storing a vacuum valve, whose shape is very complex.

However, the above-described conventional insulating supporting structure made of the organic insulating material has the problem that the dielectric strength of the surface of this insulating supporting structure would be lowered as a function of the environments in which the structure is being used.

Precisely speaking, when conductive dust is floating, and/or when wind containing salt particles is blown around the high voltage apparatus, the dust or particles have a tendency to adhere to the surfaces of the insulating supporting structure. For instance, even when the high voltage apparatus is stored within an enclosed switchboard, since the sealing performance of the enclosed switchboard is not usually high, the dust and/or particles can enter inside the enclosed switchboard. Where a rapid temperature change accompanied by high humidity happens to occur when the above-described dust/particles are attached to the surfaces of the insulating supporting structure, condensation may occur on these surfaces, thus lowering their insulation resistance. When a high voltage is applied to the surfaces under such circumstances, a partial discharge may be produced. Under the above condition, the surfaces of the organic insulating structure become carbonized due to arc heating, as a result of which a conductive path composed of carbonized organic insulating material, i.e., a so-called "tracking mark" is formed. The tracking mark will extend on the surface of the organic insulating supporting structure which is located between the high voltage charging part and the ground potential part. Sooner or later, a conductive path is formed which connects the high voltage charging part with the ground potential part thus tending to induce ground fault.

Accordingly, since the possibility exists that a tracking destroy phenomenon may occur on the conventional insulating supporting structure, the supply of power to the high voltage apparatus is periodically interrupted to remove dust/particles adhering to the surfaces of the insulating supporting structure, and a condensation preventing heater is additionally provided in order to prevent a ground fault. As a consequence, cumbersome maintenance and additional equipment are necessarily required.

SUMMARY OF THE INVENTION

An object of the present invention is to provide an electrically insulating supporting structure capable of preventing formation of a so-called "tracking mark" on a surface of the insulating supporting structure, and which does not lower the dielectric strength thereof.

Another object of the present invention is to provide a lightweight electric insulating supporting structure having a complex shape, a surface on which a so-called "tracking mark" could not be readily formed and which possesses a dielectric strength that could not be lowered.

In the first aspect of the present invention, an electrically insulating supporting structure for a high voltage electric apparatus, arranged between a high voltage charging part of the high voltage electric apparatus and a ground potential part thereof, comprises an organic insulating structure formed in a desirable shape; and an inorganic insulating layer formed on a surface of the organic insulating structure.

Here, the insulating layer may be a ceramics layer.

The insulating layer may be an alumina layer.

The insulating layer may be a zirconia layer.

The insulating layer may be a layer coated on a surface of the organic insulating structure by way of a physical vapor deposition method.

The organic insulating structure may be made of a resin selected from a polyester resin and an epoxy resin.

The insulating supporting structure may be a supporting insulator with fins.

The insulating supporting structure may be a bushing.

The insulating structure may be an insulating case for storing therein the high voltage charging part.

The insulating layer may be a layer coated on a surface of the organic insulating structure by way of a plasma spraying method.

Here, the insulating supporting structure for a high voltage apparatus may further comprise an intermediate layer formed between the insulating layer and the organic insulating structure by spraying a mixture composed of inorganic powder and organic powder.

The insulating supporting structure according to the present invention is formed such that an inorganic insulating layer such as ceramics is formed on the surface of the organic supporting structure. With this structure, since the inorganic material is not chemically changed, even when a partial discharge is produced, a tracking mark is never formed on the surface of the supporting structure converted with the inorganic layer. As a consequence, the surface dielectric strength of the insulating supporting structure would not be lowered.

In accordance with the present invention, as the insulating layer material, a ceramics material such as alumina and zirconia may be preferably employed, which may be favorably vapor-deposited on the surface of the organic insulating supporting structure by way of the plasma spraying method, or the physical vapor deposition method.

Since the inorganic layer is formed on the surface of the organic insulating supporting structure made of either the epoxy resin or the polyester resin, no tracking mark is formed on the bushing, supporting insulator, and insulating case, which is made of the organic insulating materials. Even when conductive dust is floating under high humid environments, no ground fault occurs.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

The present invention will be described hereinafter in more detail with reference to the shown embodiments. However, the present invention should not be construed as being limited thereto.

Figure 1:
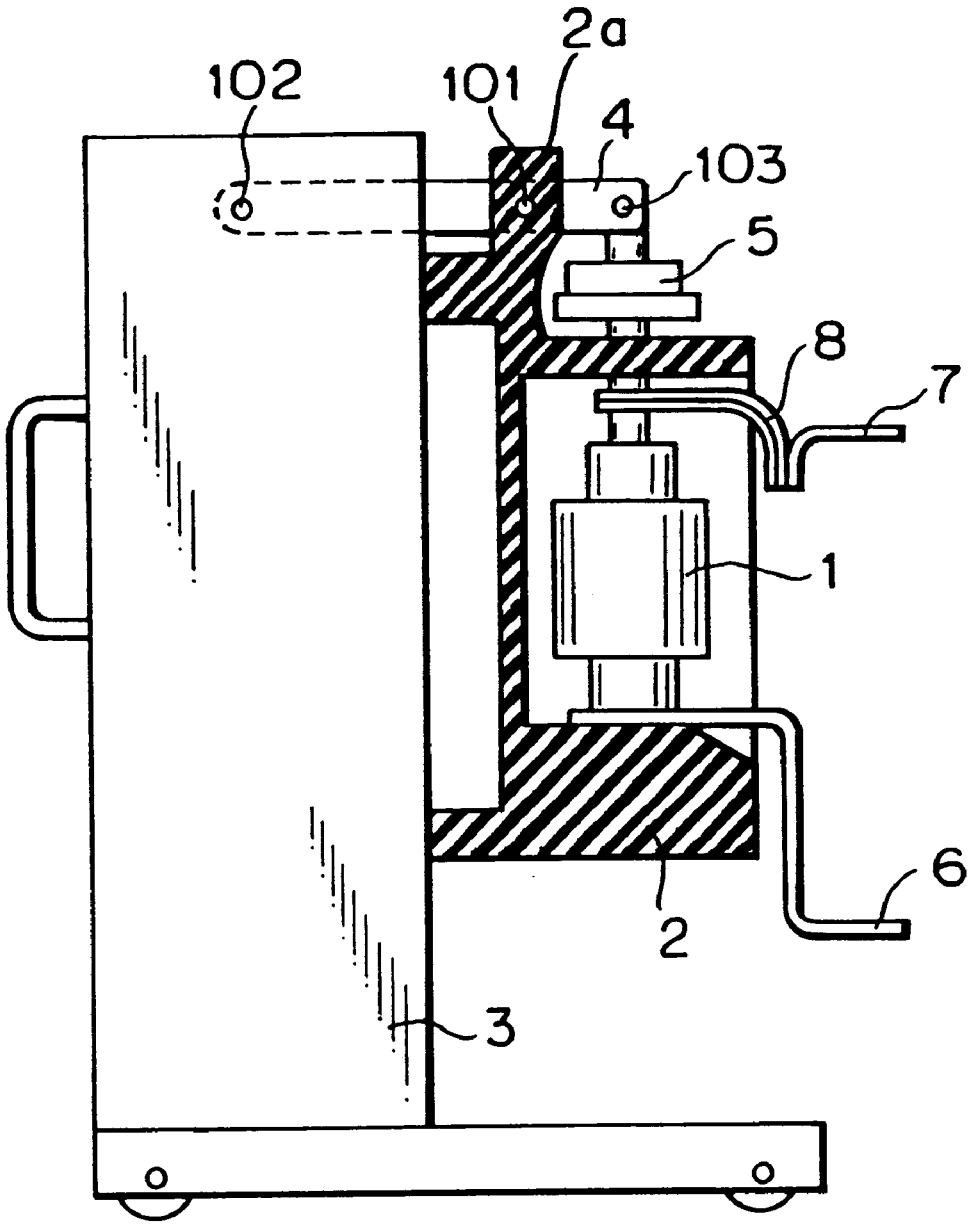
FIG. 1 is a side view showing a structure of a vacuum circuit breaker employing an electrically insulating supporting structure according to an embodiment of the present invention.

FIG. 1 is a side view showing the structure of a vacuum circuit breaker which structure includes the use of an electrically insulating supporting structure in accordance with an embodiment of the present invention. In FIG. 1, a vacuum valve 1 corresponding to a high voltage charging part is housed within an electrically insulating case 2 of an electrically insulating frame. The insulating case 2 is fixed to a carriage frame 3 of a ground potential part. Within this carriage frame 3, an operation mechanism unit (not shown) is positioned by means of which internal contacts of the vacuum valve 1 are opened or closed via an operation lever 4 and an electrically insulating rod 5. That is, the operation lever 4 is rotatably supported by a supporting unit 2*a* of the insulating case 2 via a pin 101. This pin passes through the operation lever 4 along the direction perpendicular to the longitudinal direction thereof. One end of the operation lever 4 is rotatably coupled via a pin 102 to the above-described operation mechanism unit, whereas the other end of this operation lever 4 is coupled via another pin 103 to the upper end of the insulating rod 5. The lower end of the insulating rod 5 is coupled to upper-sided contact members (not shown) employed in the vacuum valve 1. The upper-sided contact members are movable along the vertical direction in conjunction with the vertical movement of the insulating rod 5. The upper-sided contact members are connected via a flexible lead 8 and a high voltage terminal 7 through a right side opening of insulating case 2 (as shown in FIG. 1) to a main circuit of a high voltage source (not shown in detail). Lower-sided contact members (not shown either) employed within the vacuum valve 1 are connected via a high voltage terminal 6 to the main circuit of the high voltage source.

FIG. 1 shows a cross-sectional view according to which the front surface of the insulating case 2 has been cut away to reveal the vacuum valve 1 disposed within case 2. The electrically insulating frame may include three insulating cases 2, one for each phase of a three-phase system, each case having an opening at their right sides, the cases being arranged next to one another along the direction perpendicular to the plane of FIG. 1. The vacuum valves 1 for the respective phases are stored within the corresponding insulating cases 2 in such a manner that all of the three vacuum valves 1 for the three phases may be opened or closed at the same time by a single operation lever 4. The insulating case 2 may be made of either epoxy resin or polyester resin, and an inorganic material such as ceramics. For example, an alumina layer may be formed on the entire surface of this insulating case 2. The alumina layer may be formed in accordance with the general plasma spraying method. Thus, alumina powder may be supplied into a plasma jet, and thereafter, the resultant plasma alumina powder may be sprayed on the inner/outer surfaces of the insulating case 2. At this time, it is preferable to employ a double-coating method such that a mixture of alumina powder and organic material powder is initially sprayed on an organic insulating case thereby forming an intermediate layer, and in order to stop deterioration of the organic insulating case only at the surface layer portion thereof, alumina powder is thereafter sprayed on the intermediate layer. The deterioration may be caused by the high-temperature impinging alumina powder. The double-coating method described above is particularly suitable since the thickness of the resulting insulating material is small.

Figure 2:
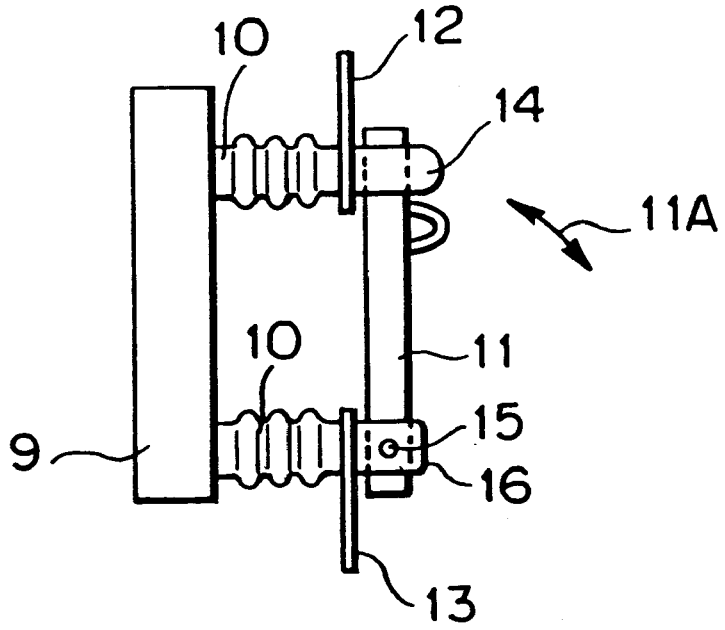
FIG. 2 is a side view showing a structure of an air circuit breaker employing an electrically insulating supporting structure according to another embodiment of the present invention.

FIG. 2 is a side view showing a structure of an air circuit breaker which structure includes the use of another electrically insulating supporting structure according to another preferred embodiment of the present invention. In FIG. 2, high voltage terminals 12 and 13 corresponding to a high voltage charging part are arranged via a supporting insulator 10 which includes fins, on a base 9 corresponding to a ground potential part. A metal member 16 on the fixed side of a blade 11 is mounted on the high voltage terminal 13, whereas another metal member 14 on the receiving side of the blade 11 is mounted on the high voltage terminal 12. The blade 11 is rotatably provided on a pin 15 functioning as a fulcrum along the direction of arrow 11A as shown in FIG. 2. The blade 11 may cause a high-voltage main circuit (not shown) connected to the high voltage terminals 12 and 13 to be turned ON/OFF.

In FIG. 2, the supporting insulator 10 is made of epoxy resin, and a ceramics layer such as a zirconia corresponding to an inorganic material is formed on the overall surface of the supporting insulator 10. The zirconia layer may be formed by employing a manufacturing method involving the use of a vacuum vapor deposition apparatus where zirconia is heated/vaporized by way of electron beams, and the resultant vaporized zirconia is deposited on the surface of the supporting insulator. Other layer forming methods may also be employed such as the sputtering method and the ion plating method, in which plasma discharge is utilized within the vacuum chamber.

Figure 3:
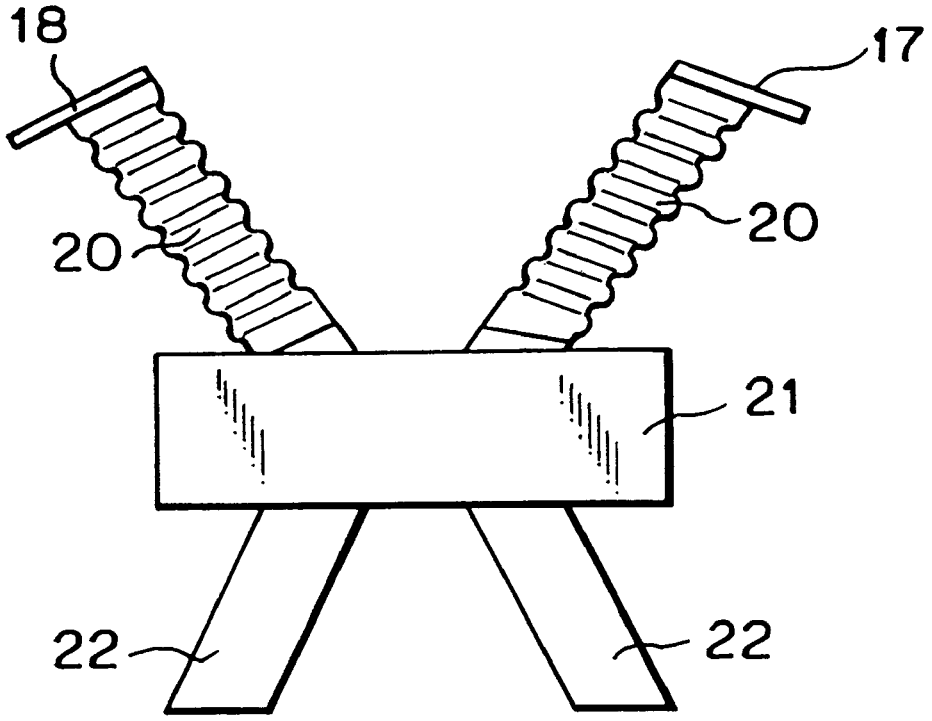
FIG. 3 is a side view showing a structure of an outdoor circuit breaker employing an electrically insulating structure according to a further embodiment of the present invention.

FIG. 3 is a side view showing a structure of an outdoor circuit breaker having another electrically insulating supporting structure. A tank 21 corresponding to the ground potential part, in which a circuit breaker (not shown) is built, is mounted on a frame 22. A bushing 20 which includes fins, is mounted on tank 21. Bushing 20 corresponds to the insulating supporting structure. Both ends of the circuit breaker provided within the tank 21 are led via the bushing 20 to the high voltage terminals 17 and 18, which constitute a high voltage charging part. The high voltage terminals 17 and 18 are connected to a high-voltage main circuit (not shown).

In FIG. 3, the bushing 20 is made of epoxy resin. A ceramics layer such as an alumina layer corresponding to an inorganic material is formed on the overall surface of the bushing 20. The alumina layer may be formed in a manner similar to that of the first embodiment.

Figure 4:
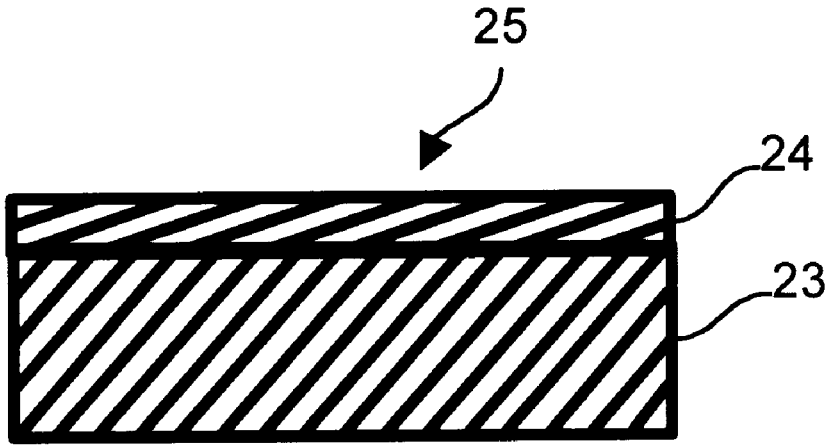
FIG. 4 is a sectional view showing an enlarged major portion of an insulating supporting structure for a high-voltage apparatus according to the present invention.

FIG. 4 is a sectional view showing an enlarged major portion of an insulating supporting structure used in a high voltage apparatus, according to the present invention. In FIG. 4, an electrically insulating supporting structure 25 corresponds to, for instance, the insulating case 2 of FIG. 1, the supporting insulator 10 of FIG. 2, or the bushing 20 of FIG. 3. An inorganic layer 24 is formed on a surface of an organic insulating structure 23.

In general, even when a partial discharge happens to occur on a surface of an inorganic insulating material, a so-called "tracking mark" is never produced. This fact is clearly described at page 471 of the Japanese publication entitled "Discharge Handbook (revised version)" issued in 1974 by Electrical Engineering Institute, and may also be understood from the phenomenon that, even when a partial discharge is produced at an outdoor insulator or a bushing made entirely from ceramics after a rain fall, no tracking mark is produced.

As illustrated in FIG. 4, it is preferable to form the layer 24 on the surface of the organic insulating structure 23 by way of the vapor deposition method, for instance by way of the plasma spraying method and the physical vapor deposition method. As the material to be used in the layer 24, apart from the oxide as employed in the embodiment of FIG. 3, other materials having an electrically insulating character, such as nitride, boride, carbide or the like may be employed. A thickness of this layer 24 may be small, that is, in the order of 1 to 5 micrometers.

Figure 5:
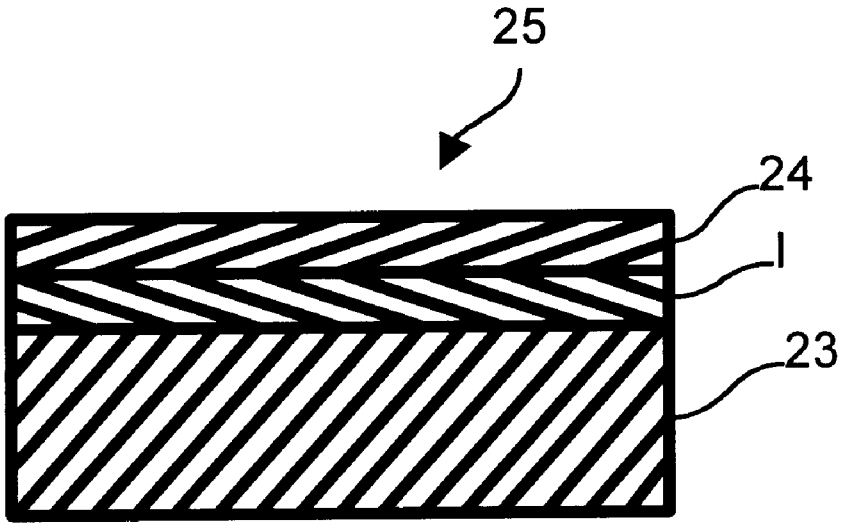
FIG. 5 is a view similar to FIG. 4 showing a three layer structure.

FIG. 5 is a view similar to FIG. 4 showing an intermediate layer I formed between layers 23 and 24.

As previously described in detail, where, in accordance with the instant invention, an inorganic layer such as a layer made of ceramics is formed on the surface of the organic insulating structure, tracking marks are longer produced on this surface. Moreover, according to the instant invention, the disclosed insulating supporting structure which has a complex shape and a light weight can be easily manufactured. As a result, the available dielectric strength is not lowered, and furthermore, no ground faults occur even under unfavorable environments for the high voltage apparatus. Accordingly, maintenance work such as the work required for periodically wiping the surface of a high voltage apparatus is no longer required, and, furthermore, no condensation preventing heater is required.

In addition, since the insulating supporting structure made according to the present invention can endure ultraviolet radiation, it may be used in outdoor fields. According to other advantageous embodiments of the invention, the bushing and the insulator with the fins, which components are made entirely of ceramics according to the prior art, may be made of organic insulating materials, resulting in a light weight and a high mechanical strength. Since the final shape of the insulating supporting structure can be freely determined, an electrically insulating case having a very complex structure can be easily manufactured although such a complex structure could not be made of the ceramics material.

The present invention has been described in detail with respect to preferred embodiments, but it is to be understood that changes and modifications may be made thereto without departing from the invention in its broader aspects. Therefore, the appended claims cover all changes and modifications that fall within the true spirit of the invention.

What is claimed is:

1. An electrically insulating supporting structure for a high voltage electric apparatus having a high voltage charging part and a ground potential part, the structure being adapted to be disposed between the high voltage charging part and the ground potential part, the structure comprising:

an organic insulating structure formed in a predetermined shape;

an inorganic insulating layer comprising a layer coated on a surface of the organic insulating structure; and an intermediate layer containing a mixture consisting essentially of organic powder and inorganic powder and located between the insulating layer and the organic insulating structure.

2. The electrically insulating supporting structure according to claim 1, wherein the insulating layer is made of a ceramic material.

3. The electrically insulating supporting structure according to claim 2, wherein the insulating layer is made of alumina.

4. The electrically insulating supporting structure according to claim 2, wherein the insulating layer is made of zirconia.

5. The electrically insulating supporting structure according to claim 1, wherein the organic insulating structure is made of a resin selected from the group consisting of polyester and epoxy.

6. The electrically insulating supporting structure according to claim 1, wherein the organic insulating structure is an insulator having fins thereon.

7. The electrically insulating supporting structure according to claim 1, wherein the organic insulating structure is a bushing.

8. The electrically insulating supporting structure according to claim 1, wherein the organic insulating structure is an insulating case adapted for storing the high voltage charging part therein.

* * * * *